US008535087B1

(12) United States Patent
McKee et al.

(10) Patent No.: US 8,535,087 B1
(45) Date of Patent: Sep. 17, 2013

(54) ELECTRICAL CONNECTOR EQUIPPED WITH DETECTION SWITCH

(75) Inventors: Michael McKee, Camp Hill, PA (US); Howard Wallace Andrews, Hummelstown, PA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 11 days.

(21) Appl. No.: 13/418,355

(22) Filed: Mar. 13, 2012

(51) Int. Cl.
*H01R 3/00* (2006.01)

(52) U.S. Cl.
USPC ..... 439/489

(58) Field of Classification Search
USPC ..... 439/489, 540.1, 541.5, 607.23, 607.5, 439/607.32, 607.01
See application file for complete search history.

(56) References Cited

U.S. PATENT DOCUMENTS 6,238,244 B1 * 5/2001 Yang ..... 439/607.01
6,609,929 B2 * 8/2003 Kamarauskas et al. .... 439/541.5
7,008,762 B2 * 3/2006 Zhang et al. ..... 439/541.5
7,311,556 B2 * 12/2007 Wan et al. ..... 439/607.32
7,670,191 B2 * 3/2010 Ortega et al. ..... 439/660
7,922,525 B2 * 4/2011 Lee ..... 439/541.5
2002/0048992 A1 * 4/2002 Wang et al. ..... 439/607
2005/0255745 A1 * 11/2005 Walker et al. ..... 439/541.5
2007/0042643 A1 * 2/2007 Zhang et al. ..... 439/607
2009/0311909 A1 * 12/2009 Yu et al. ..... 439/607.23

FOREIGN PATENT DOCUMENTS

CN 201430314 Y 3/2010

* cited by examiner

*Primary Examiner* — Jean F Duverne
(74) *Attorney, Agent, or Firm* — Wei Te Chung; Ming Chieh Chang

(57) ABSTRACT

An electrical connector includes an insulative housing with a plurality of conductive terminals mounted thereon. A metallic shell surrounds the insulative housing thereby defining a mating cavity therein for receiving a mating plug. A spring plate is formed on one side wall of the metallic shell and projects into the mating cavity. A terminal module is attached to said side wall of the metallic shell and separated from the insulative housing by said side wall. The terminal module has a body section and a conductive terminal. The spring plate together with the conductive terminal form a detection switch which can detect whether a mating plug is inserted or not.

10 Claims, 7 Drawing Sheets

ELECTRICAL CONNECTOR EQUIPPED WITH DETECTION SWITCH

BACKGROUND OF THE INVENTION

1. Field of the Invention

The present invention relates to an electrical connector, and more particular to an electrical connector having a detection switch properly and accurately indicating insertion and removal of a mating plug therein.

2. Description of the Related Art

Chinese Pat. No. 200920302251 issued on Mar. 24, 2010 discloses an electrical connector equipped with a detective switch for detecting insertion and removal of a mating plug therein. This electrical connector comprises a rectangular housing and a metallic shell surrounding the housing. The rectangular housing defines a recess in a middle of a front portion thereof, in which a mating tongue is formed with a plurality of contacts disposed at opposite sides thereof. A gap is defined between one side of the mating tongue and the housing, in which a detective switch is arranged for detecting whether a mating plug is inserted or unplugged. The detective switch extend into the gap so as to intercept with a displacement of the inserted plug or disengagement with the inserted plug. Other solutions of the detective switch may be provided according to varies demand.

SUMMARY OF THE INVENTION

Accordingly, an object of the present invention is to provide an electrical connector having a detective switch.

In order to achieve the object set forth, an electrical connector comprises an insulative housing with a plurality of conductive terminals mounted thereon. A metallic shell surrounds the insulative housing thereby defining a mating cavity therein for receiving a mating plug. A spring plate is formed on one side wall of the metallic shell and projects into the mating cavity. A terminal module is attached to said side wall of the metallic shell and separated from the insulative housing by said side wall. The terminal module comprises a body section and a conductive terminal. The spring plate together with the conductive terminal form a detection switch under condition that the spring plate is separated from the conductive terminal before the mating plug is inserted into the mating cavity, while the spring plate will move outwardly to get into contact with the conductive terminal when the mating plug is inserted into the mating cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
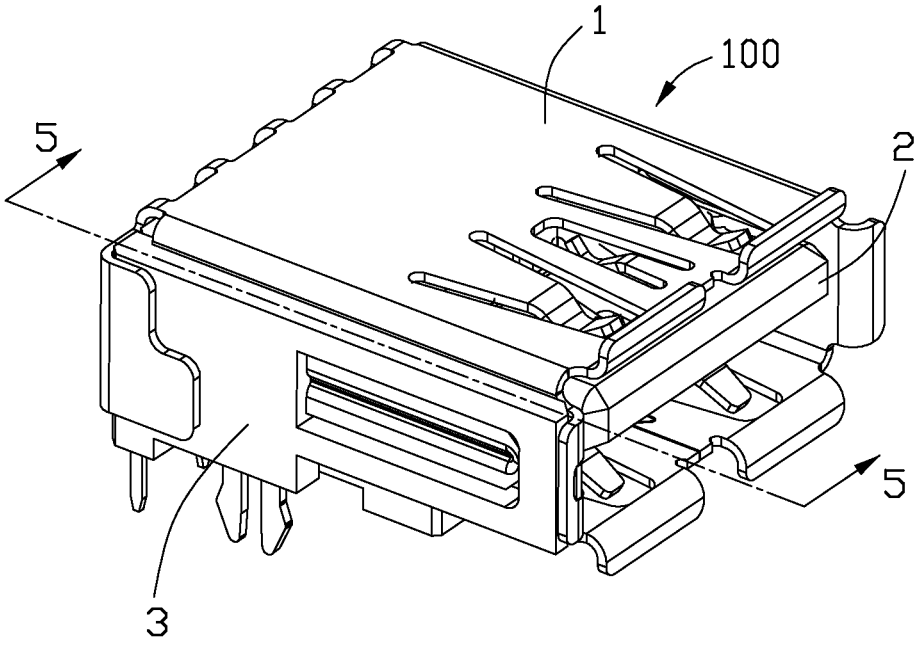
FIG. 1 is a perspective view of an electrical connector in accordance with the present invention.
Figure 2:
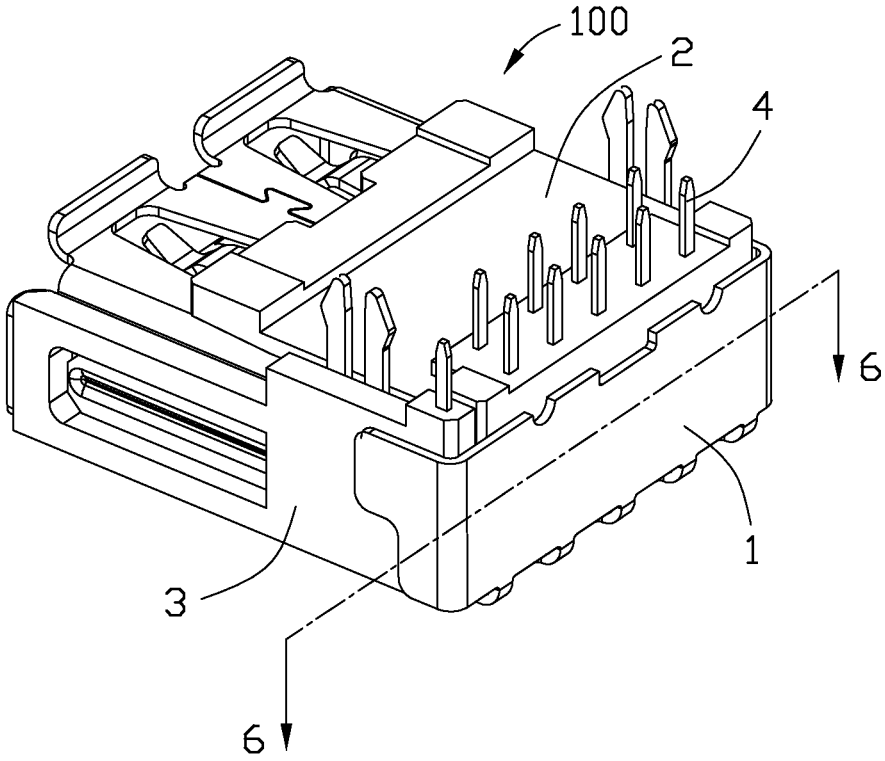
FIG. 2 is another perspective view of the electrical connector shown in FIG. 1, seen from a bottom side.

Reference will now be made to the drawing figures to describe a preferred embodiment of the present invention in detail.

Referring to FIG. 1 to FIG. 4, an electrical connector 100 in accordance with the present invention is provided and comprises a metallic shell 1, an insulative housing 2, a terminal module 3 and a plurality of contacts 4.

In this embodiment, the electrical connector 100 is configured as a standard USB 3.0 connector, it should be pointed out that the other similar electrical connectors with a metallic shell surrounded outside, such as USB 2.0 connector, eSATA connector, Display Port connector and et al, are also suitable for incorporation of the present invention. As the structure of the USB 3.0 connector is not the key points of the present invention, for simplification, the detail description of the USB 3.0 connector which can be referred and best illustrated by U.S. Pat. No. 7,670,191 is omitted here.

The metallic shell 1 is made by stamping of a metal sheet and is configured with a top wall 11, a bottom wall 12, a first side wall 13, a second side wall 14 and a rear wall 15. The metallic shell 1 surrounds the insulative housing 2 and defines a mating cavity 10 therein for receiving a mating plug 200 therein. The rear wall 15 is formed by extending rearwardly from a rear edge of the top wall 11 and then bending downwardly. The rear wall 15 comprises a base section 151, a first wing section 153 and a second wing section 152 extending from longitudinal ends of the base section 151. The first and second wing sections 153, 152 extend forwardly and keep closer to the corresponding first and second side walls 13, 14. The first wing section 153 attaches to the first side wall 13 by a soldering method, which could keep the metallic shell 1 stably and reliably. The second wing section 152 is spaced to the second side wall 14 and leaves a gap 150 therebetween for accommodating the terminal module 3 therein. The second side wall 14 has an elongated passageway or slot 143 extending forwardly from a rear edge thereof, and at a front edge of the second side wall 14, an opening 144 is also defined and faces to the second wing sections 152. A board lock section 142 extends downwardly from a bottom edge of the second side wall 14 for retaining the electrical connector 100 onto the printed circuit board. Further, a spring plate 141 is formed on the second side wall 14 and projects inwardly until it is exposed in the mating cavity 10. The spring plate 141 could move outwardly or inwardly with the insertion or withdrawn of the mating plug 200.

Figure 3:
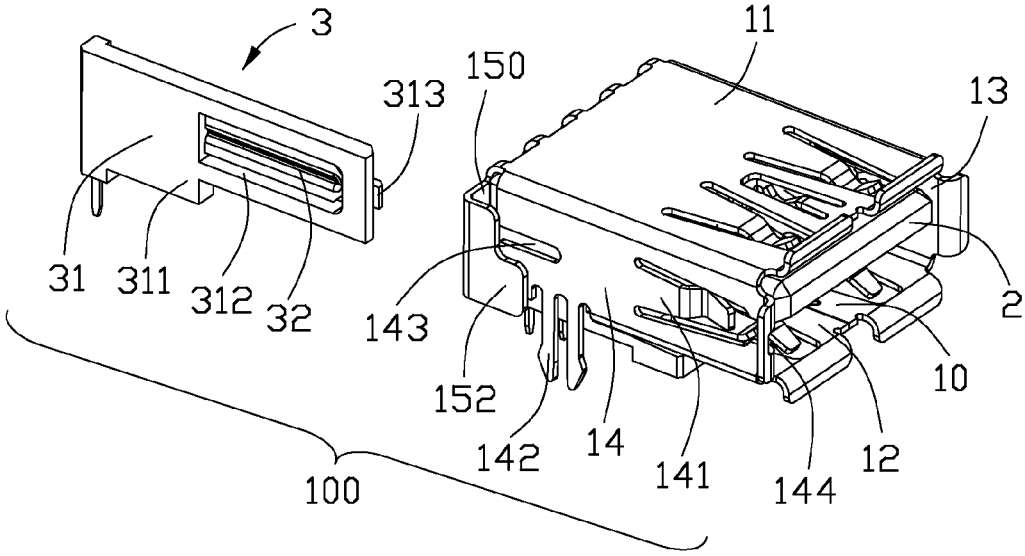
FIG. 3 is a partly exploded perspective view of the electrical connector shown in FIG. 1.
Figure 4:
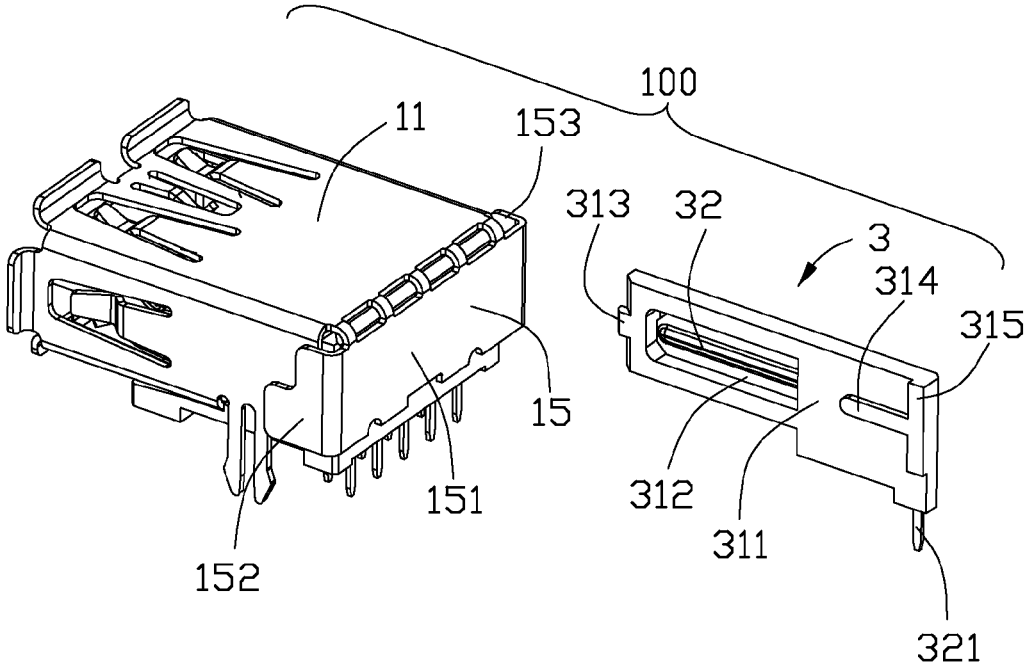
FIG. 4 is another partly exploded view of the electrical connector shown in FIG. 3.
Figure 5:
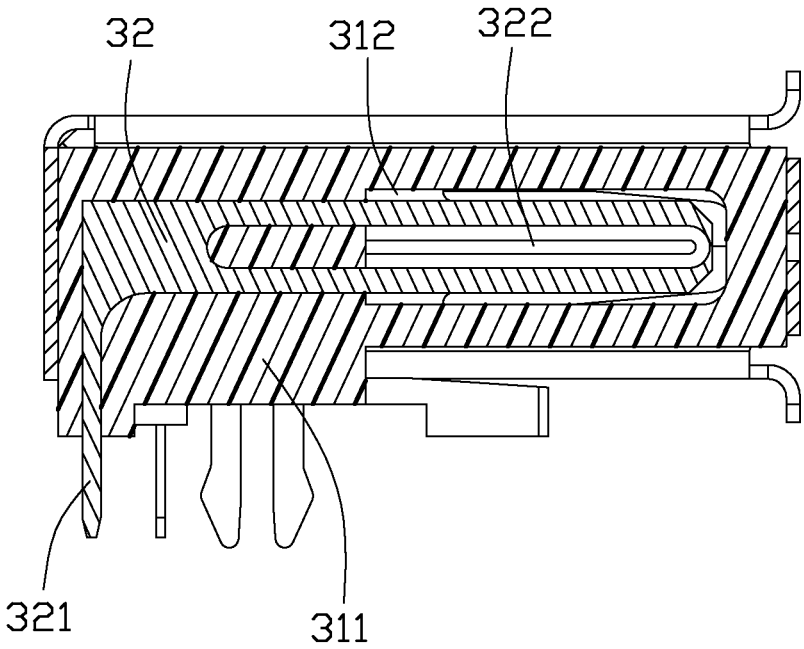
FIG. 5 is a cross sectional view of the electrical connector shown in FIG. 1 along line 5-5.

Referring to FIG. 3 to FIG. 5, the terminal module 3 comprises a rectangular body section 31 made of insulative material, i.e., the insulator, and a conductive terminal or detect pin 32 insert-molded in the body section 31. The body section 31 is configured as an L-shaped contour as seen from a top side, which comprises a plate section 311 and an ending section 315 perpendicular to the plate section 311. The plate section 311 defines an elongated opening 312 at a front section, in which the conductive terminal 32 is exposed. A retaining bar 314 extends forwardly and horizontally from the ending section 315. A locking portion 313 protrudes forwardly from a front edge of the plate section 311. The conductive terminal 32 comprises a contacting portion 322 and a soldering portion 321 extending downwardly from the contacting portion 322 and projecting out of the plate section 311.

Referring to FIG. 3 to FIG. 7, the terminal module 3 is assembled on the second side wall 14 along a rear-to-front direction. Firstly, the retaining bar 314 is inserted into the elongated passageway 143 until the locking portion 313 retained in the opening 144 at the front edge of the second side wall 14. Secondly, the rear wall 15 is bending downwardly with the first and second wing sections 151, 152 projecting forwardly. The second wing section 152 is located at an outer side of the body section 31 of the terminal module 3, therefore the body section 31 could be sandwiched within the gap 150 defined by the second side wall 14 and the second wing section 152. Finally, the first wing section 151 is soldered onto the first side wall 13.

Figure 6:
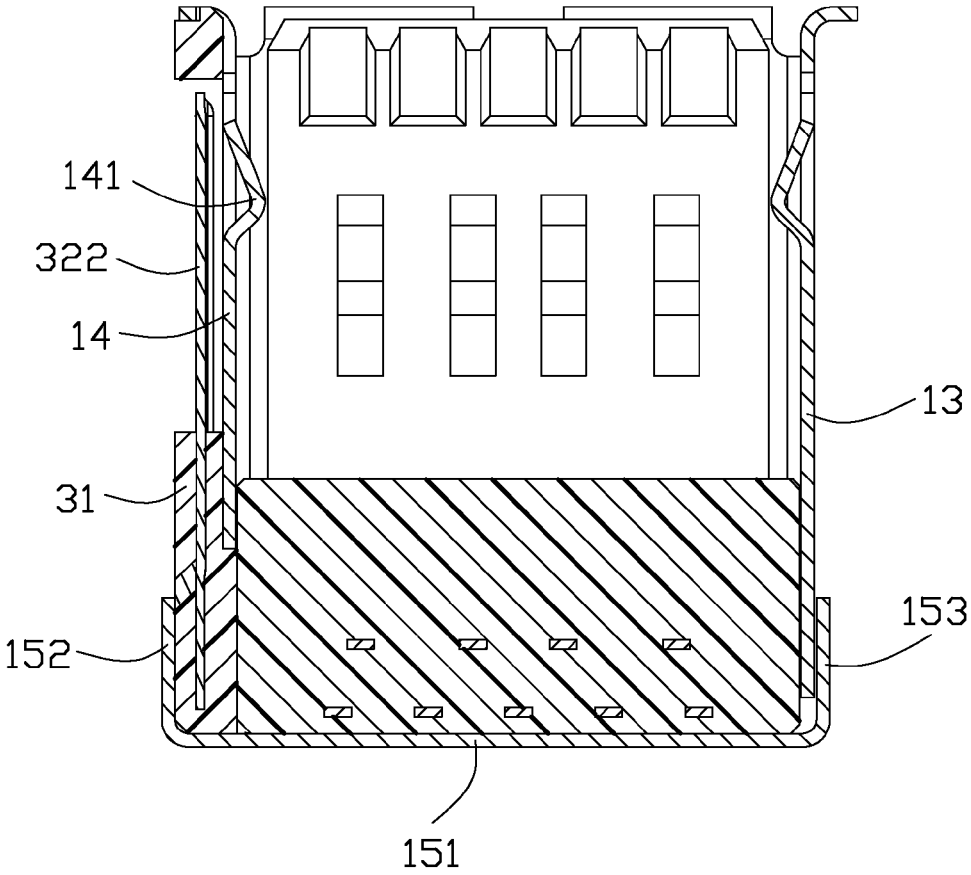
FIG. 6 is a cross sectional view of the electrical connector shown in FIG. 2 along line 6-6, which shows status of a switch when a mating plug is not inserted.
Figure 7:
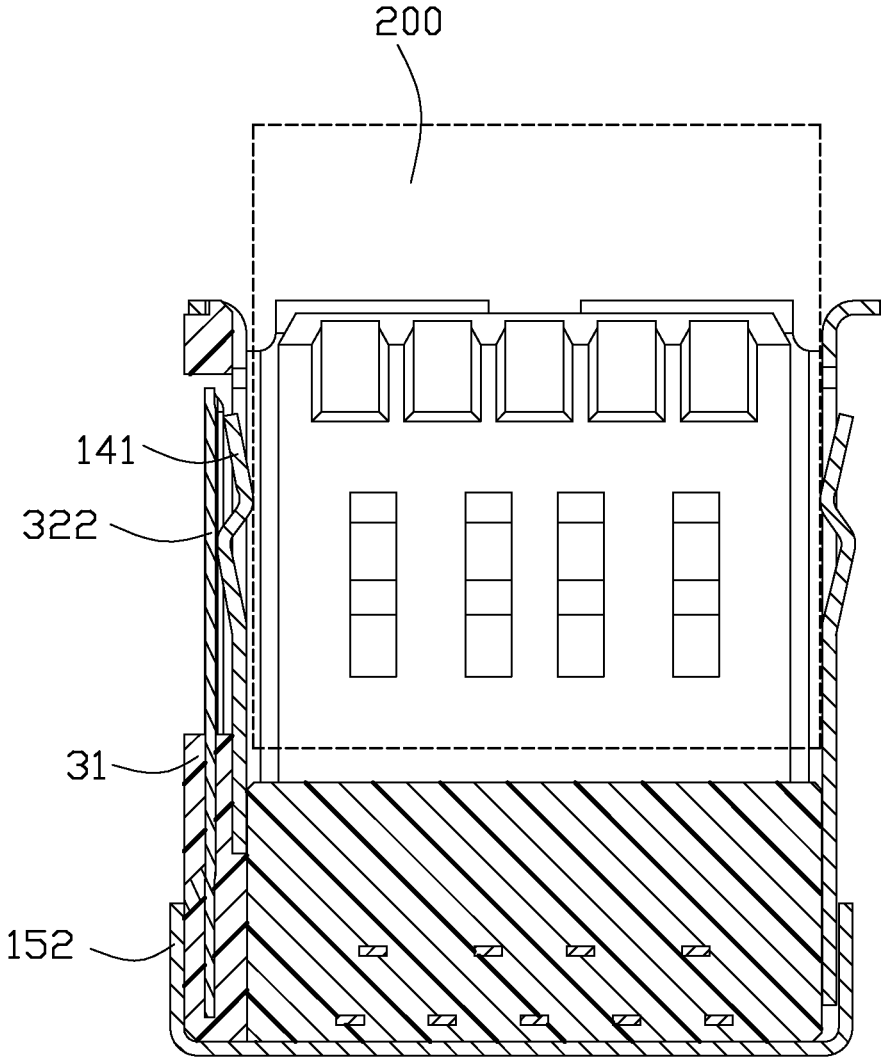
FIG. 7 is similar to FIG. 6 and shows status of the switch when the mating plug is inserted.

Referring to FIG. 5 to FIG. 7, as the terminal module 3 is adjacent to the second side wall 14, the spring plate 141 could get in touch with the contacting section 322 of the terminal module 3 when the spring plate 141 is biased by the inserted mating plug 200. That is to say, the spring plate 141 and the conductive terminal 32 could form a detection switch for the electrical connector 100 to detect whether the mating plug 200 is inserted. The conductive terminal 32 acts as a stationary contact while the spring plate 141 of the metallic shell 1 acts as a movably contact. When the mating plug 200 is not inserted into the mating cavity 10, the spring plate 141 is separated from the conductive terminal 32. When the mating plug 200 is inserted into the mating cavity 10, the spring plate 141 is biased to move outwardly and engages with the contacting section 322 of the conductive terminal 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing with a plurality of conductive terminals mounted thereon;

a metallic shell surrounding the insulative housing thereby defining a mating cavity therein for receiving a mating plug, a spring plate being formed on one side wall of the metallic shell and projecting into the mating cavity; and a terminal module, attached to said side wall of the metallic shell and separated from the insulative housing by said side wall, the terminal module comprising a body section and a conductive terminal;

wherein the spring plate together with the conductive terminal form a detection switch under condition that the spring plate is separated from the conductive terminal before the mating plug is inserted into the mating cavity, while the spring plate will move outwardly to get into contact with the conductive terminal when the mating plug is inserted into the mating cavity;

wherein the body section of the terminal module forms a retaining bar thereon for inserting into an elongated passageway defined on said side wall along a rear-to-front direction; wherein an opening is formed on a front edge of said side wall for receiving a locking portion formed on a front end of the body section; wherein the metallic shell comprises a top wall, a bottom wall, side walls connecting with said top and bottom walls, and a rear wall extending rearward and downward from said top wall, a wing section is formed on one side of the rear wall to buckle an outer side of the terminal module; wherein another wing section is also formed on the other side of the rear wall and directly attached to the corresponding side wall.

2. The electrical connector as described in claim 1, wherein the conductive terminal is insert-molded in the body section and partly exposed exteriorly by an opening defined on the body section.

3. The electrical connector as described in claim 2, wherein the conductive terminal comprises a contacting portion which faces to the spring plate through said opening and a soldering portion extending out of the body section.

4. An electrical connector for mating with a mating plug comprising:

a first insulative housing with a plurality of contacts mounted therein, said contacts engaged with corresponding contacts formed within the mating plug;

a second insulative housing which is an individual part, having one single terminal retained therein; and a metallic shell surrounding the first insulative housing so as to define a mating cavity for receiving said mating plug and forming a locking mechanism on an exterior side so as to retain said second insulative housing thereon;

wherein a spring plate is formed on said exterior side of the metallic shell to cooperate with said single terminal so as to form a detection switch, which could detect whether the mating plug is inserted into the receiving cavity or not; wherein the detection switch engages with a periphery of the mating plug when the mating plug is inserted into the receiving cavity; wherein the single terminal is insert-molded with the second insulative housing and partly exposed to an exterior by an opening defined on the second insulative housing; wherein the single terminal comprises a contacting portion which faces to the spring plate through said opening and a soldering portion extending out of the second insulative housing.

5. The electrical connector as described in claim 4, wherein the second insulative housing forms a retaining bar thereon for inserting into an elongated passageway defined on said exterior side of the metallic shell along a rear-to-front direction.

6. The electrical connector as described in claim 5, wherein the locking mechanism comprises a wing section formed on a rear section of the metallic shell and spaced to said exterior side so as to define a gap therebetween for receiving said second insulative housing.

7. The electrical connector as described in claim 6, wherein an opening is defined at a front edge of said exterior side for receiving a protrusion formed on a front end of the second insulative housing.

8. The electrical connector as described in claim 7, wherein the second insulative housing is configured as an L-shaped contour as seen from a top side.

9. An electrical connector for use with a plug, comprising:

an insulative housing;

a metallic shell enclosing said housing to commonly define a mating port;

a spring plate unitarily extending from the shell via stamping and into the mating port;

a plurality of contacts disposed in the housing with contacting sections extending into the mating port; and a detect pin located outside of the mating port and intimately adjacent to said spring plate so as to mechanically and electrically connect to the spring plate when said spring plate is outwardly deflected by the plug inserted into the mating port; wherein both said contacts and said detect pin have corresponding tails, respectively, for mounting to a printed circuit board on which the connector is seated; wherein said detect pin is enclosed in an insulator which abuts against the shell for positioning; wherein said insulator is located on a lateral side of and secured by the shell; wherein said shell further defines a wing section pressing upon an exterior face of the insulator.

10. The electrical connector as claimed in claim 9, wherein said shell defines a slot, and the insulator defines a retaining bar received in the slot for restricting movement of the insulator relative to the shell.

* * * * *